US008944160B2

(12) United States Patent
Surjaatmadja et al.

(10) Patent No.: US 8,944,160 B2
(45) Date of Patent: Feb. 3, 2015

(54) PULSATING ROTATIONAL FLOW FOR USE IN WELL OPERATIONS

(75) Inventors: Jim B. Surjaatmadja, Duncan, OK (US); Timothy H. Hunter, Duncan, OK (US); Robert L. Pipkin, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 217 days.

(21) Appl. No.: 13/541,103

(22) Filed: Jul. 3, 2012

(65) Prior Publication Data

US 2014/0008070 A1 Jan. 9, 2014

(51) Int. Cl.
*E21B 37/00* (2006.01)
*E21B 17/18* (2006.01)

(52) U.S. Cl.
USPC ..... 166/177.6; 166/177.7; 175/232; 175/241; 175/242

(58) Field of Classification Search
CPC ..... E21B 28/00; E21B 37/00; E21B 7/24
USPC ..... 166/177.6, 177.7; 175/232, 241, 242
See application file for complete search history.

(56) References Cited

U.S. PATENT DOCUMENTS 3,373,825 A * 3/1968 Guin ..... 173/59
3,648,786 A * 3/1972 Chenoweth ..... 175/56
5,505,262 A 4/1996 Cobb
5,893,383 A 4/1999 Facteau
6,237,701 B1 5/2001 Kolléet al.
6,301,766 B1 10/2001 Kollé
6,887,176 B2 5/2005 Sasaki
6,976,507 B1 12/2005 Webb et al.
7,429,332 B2 9/2008 Surjaatmadja et al.
7,931,095 B2 4/2011 Machida et al.
8,381,817 B2 * 2/2013 Schultz et al. ..... 166/319
2005/0214147 A1 9/2005 Schultz et al.
2013/0048274 A1 2/2013 Schultz et al.
2013/0233620 A1 * 9/2013 Rankin ..... 175/57

FOREIGN PATENT DOCUMENTS

EP 0304988 A1 3/1989

OTHER PUBLICATIONS

International Search Report and Written Opinion issued Sep. 25, 2013 for PCT Patent Application No. PCT/US2013/044889, 14 pages.

* cited by examiner

*Primary Examiner* — Kenneth L Thompson
*Assistant Examiner* — Wei Wang
(74) *Attorney, Agent, or Firm* — Smith IP Services, P.C.

(57) ABSTRACT

A system for use with a subterranean well can include a fluid oscillator which discharges pulsating fluid from a tubular string in a direction at least partially toward an end of the tubular string proximate a surface of the earth. A method can include discharging a fluid from the tubular string, thereby applying a reaction force to the tubular string, which reaction force biases the tubular string at least partially into the well. Another method can include discharging a pulsating fluid from a fluid oscillator in a direction at least partially toward an end of the tubular string, and drilling into an earth formation with a drill bit connected at an opposite end of the tubular string in the well.

30 Claims, 8 Drawing Sheets

PULSATING ROTATIONAL FLOW FOR USE IN WELL OPERATIONS

BACKGROUND

This disclosure relates generally to equipment utilized and operations performed in conjunction with a subterranean well and, in an example described below, more particularly provides a pulsating rotational flow for use in well operations.

In drilling a well, rock cuttings are produced by a drill bit cutting into a subterranean formation. These cuttings should be carried out of the well, so that drilling can continue. In well cleaning, particulate material produced by the cleaning should be carried out of the well.

In many different types of well operations, it can be difficult to advance a tubular string into the well. For example, if the tubular string comprises coiled tubing, a flexibility of the tubing may prevent it from being pushed into the well.

For the above reasons and others, it will be appreciated that improvements are continually needed in the art.

SUMMARY

In the disclosure below, systems and methods are provided which brings improvements to the art. One example is described below in which a fluid oscillator is configured so that it produces pulsating upward and rotational flow about a tubing string. Several examples are described below in which one or more fluid oscillators are used to enhance drilling, well cleaning and particulate removal operations.

A system for use with a subterranean well is described below. In one example, the system can include a fluid oscillator which discharges pulsating fluid from a tubular string in a direction at least partially toward an end of the tubular string proximate a surface of the earth.

A method for use with a subterranean well is also described below. The method can include discharging a fluid from the tubular string, thereby applying a reaction force to the tubular string, which reaction force biases the tubular string at least partially into the well.

Another method can comprise: discharging a pulsating fluid from a fluid oscillator in a direction at least partially toward an end of the tubular string; and drilling into an earth formation with a drill bit connected at an opposite end of the tubular string in the well.

Yet another method can comprise: discharging a fluid from a tubular string in the well, thereby applying a vibratory reaction force to the tubular string, which reaction force is directed at least partially toward an end of the tubular string in the well.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
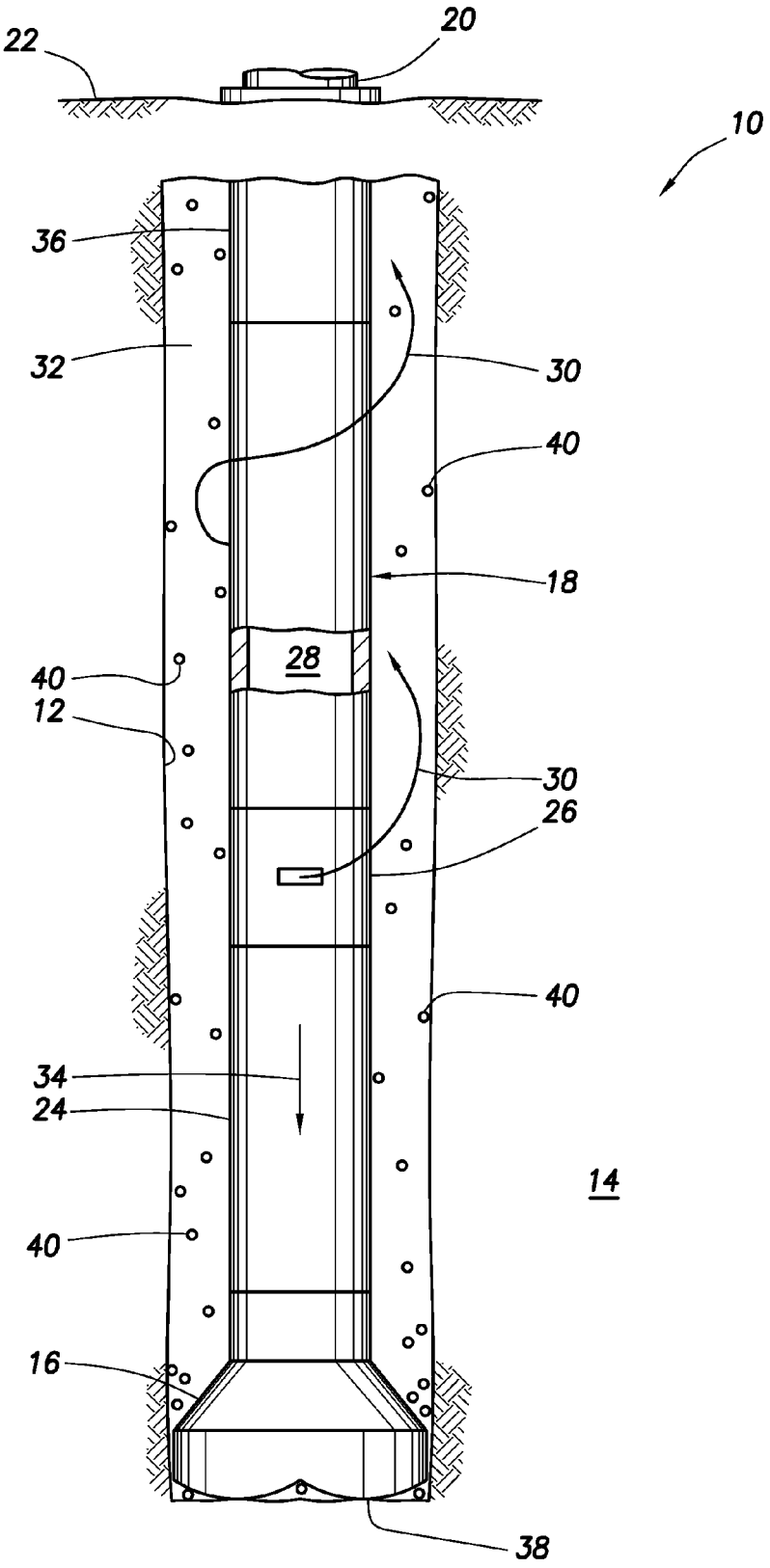
FIG. 1 is a representative partially cross-sectional view of one example of a well system and associated method which can embody principles of this disclosure.

Representatively illustrated in FIG. 1 is an example of a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled so that it penetrates an earth formation 14. For this purpose, a drill bit 16 is connected to a tubular string 18 in the wellbore 12. An upper end 20 of the tubular string 18 extends to a location at or near the earth's surface 22 (such as, a land rig, a subsea wellhead, a drill ship or platform, etc.).

Rotation of the drill bit 16 (in conjunction with weight or other force applied to the tubular string 18) may cause it to cut into the formation 14. In that case, the drill bit 16 could be rotated by rotating the tubular string 18 from the surface 22 (e.g., using a rotary table or a top drive, etc.), and/or the drill bit could be rotated by means of a fluid motor 24 (such as a Moineau-type or a turbine-type mud motor) interconnected in the tubular string 18.

Alternatively, or in addition, the drill bit 16 could cut into the formation 14 due to impacts delivered to the drill bit. For example, a hammer drill could be used. Thus, it will be appreciated that the scope of this disclosure is not limited to any particular type of drilling operation and, indeed, is not limited to drilling operations at all.

The tubular string 18 could have additional components, or fewer or different components, in keeping with the scope of this disclosure. For example, reamers, stabilizers, directional drilling equipment, measurement-while-drilling (MWD) equipment, logging-while-drilling (LWD) equipment, pressure-while-drilling (PWD) equipment and/or telemetry components could be included. The tubular string 18 could be equipped with lines (e.g., electrical, optical, hydraulic, etc., lines) in a sidewall thereof, or in an internal flow passage 28 of the tubular string. Therefore, it will be appreciated that the scope of this disclosure is not limited to any particular type or configuration of the tubular string 18.

In the FIG. 1 example, a fluid oscillator 26 is interconnected in the tubular string 18. The fluid oscillator 26 is longitudinally spaced apart from the drill bit 16, with the fluid motor 24 being interconnected between the fluid oscillator and the drill bit.

However, this configuration is not necessary in keeping with the scope of this disclosure. For example, the fluid oscillator 26 could be adjacent to, or part of, the drill bit 16 or fluid motor 24.

In other examples, the drill bit 16 and fluid motor 24 may not be used. Thus, the scope of this disclosure is not limited to any particular arrangement or combination of components in the tubular string 18.

A fluid 30 is flowed through the passage 28 to the fluid oscillator 26. The fluid oscillator 26 produces pulsations in the flow of the fluid 30, and discharges the fluid into an annulus 32 formed radially between the tubular string 18 and the wellbore 12.

A suitable manner of producing pulsations in the flow of the fluid 30 is described in U.S. patent application Ser. No. 13/215,572, filed 23 Aug. 2011. However, in the system 10 of FIG. 1, the fluid 30 is discharged upward, or at least partially in a direction toward the upper end 20 of the tubular string 18, which produces significant benefits.

The pulsating flow of the fluid 30 enhances a cleaning effect of the discharged fluid in the annulus 32. In addition, since the flow is pulsing, a resulting reaction force 34 applied to the tubular string 18 is vibratory. This vibratory reaction force 34 applied to the drill bit 16 can enhance its cutting action.

The reaction force 34 can also bias the tubular string 18 to advance into the wellbore 12 as drilling progresses. This can be particularly useful where the tubular string 18 comprises coiled tubing 36 (e.g., tubing that is wrapped on a spool prior to being deployed into a well), the wellbore 12 is inclined from vertical, etc.

In the FIG. 1 example, the fluid oscillator 26 discharges the fluid 30 toward the upper end 20 of the tubular string 18, and away from a lower end 38 at which the drill bit 16 is connected. In addition, the fluid oscillator 26 preferably discharges the fluid 30 so that it flows rotationally about the tubular string 18. Thus, the fluid 30 flows generally helically in the annulus 32.

This helical flow can enhance a lifting of particulate matter 40 (e.g., drill cuttings, debris, sand, etc.) from the wellbore 12 with the fluid 30. In particular, the helical flow of the fluid 30 can mitigate convective effects in the annulus 32 (which can accelerate settling of the particulate matter 40), in cases where the wellbore 12 is inclined from vertical.

The vibration of the tubular string 18 can enhance the removal of the particulate matter 40 via the annulus 32, thereby aiding the cleaning process. Since the pulsating flow of the fluid 30 can be axially and/or rotationally directed, the resultant reaction force 34 (and associated vibration of the tubular string 18) can also be axially and/or rotationally directed. In particular, it is contemplated that a combination of axial and rotational (e.g., helical) vibration can help with sweeping the particulate matter 40 up the annulus 32 toward the surface 22.

Figure 2:
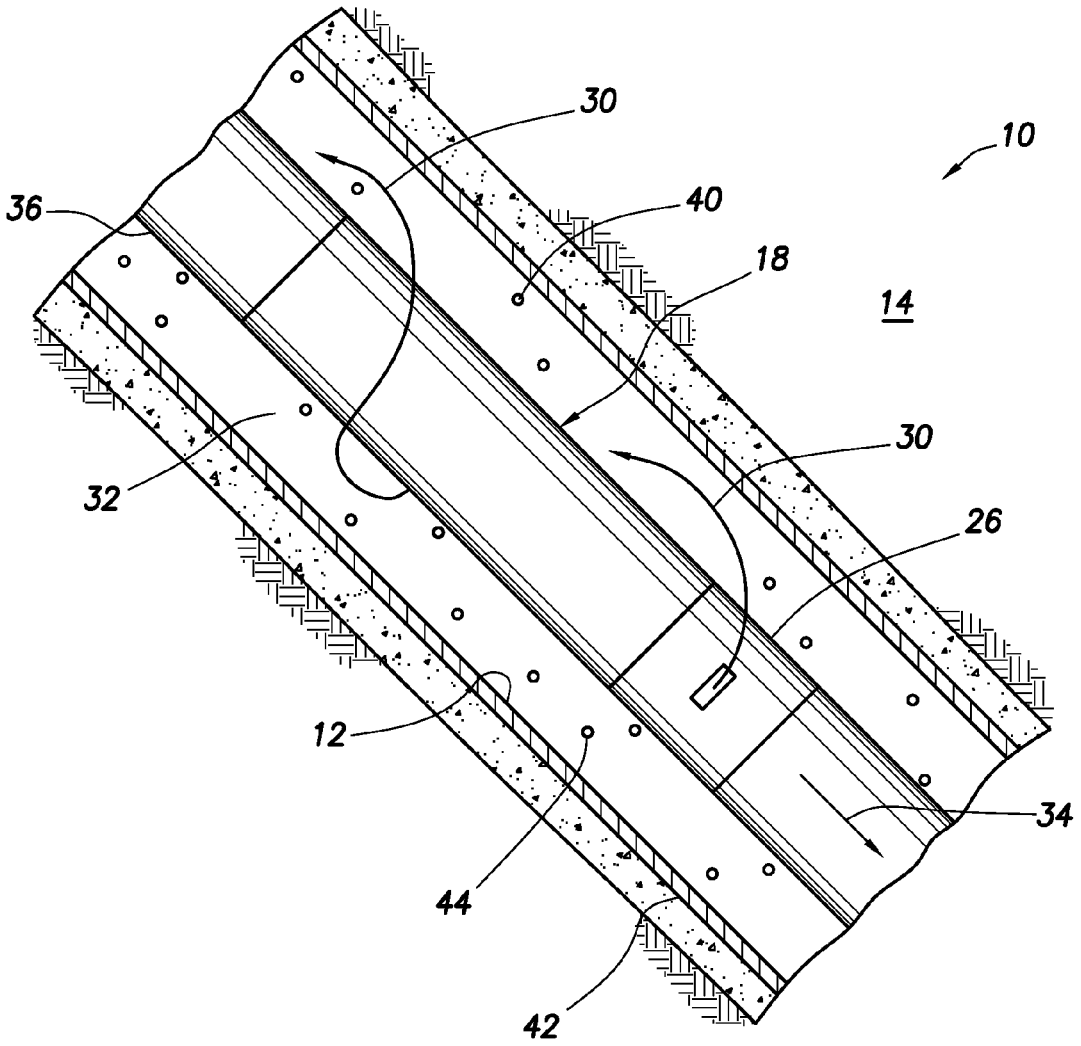
FIG. 2 is a representative partially cross-sectional view of another example of the system and method.

Referring additionally now to FIG. 2, another example of the system 10 and method is representatively illustrated. The FIG. 2 example is similar in many respects to the FIG. 1 example. However, one significant difference in the FIG. 2 example is that the wellbore 12 is inclined (e.g., deviated) from vertical, and is lined with casing 42 and cement 44.

A drilling operation is not necessarily performed in the FIG. 2 example. Instead, in the FIG. 2 example it may be desired for the fluid 30 to carry the particulate matter 40 through the annulus 32, e.g., to clean the wellbore 12 of debris, sand, etc.

In some examples, the fluid oscillator 26 may be used to clean one or more well surfaces (such as, a surface of the formation 14 exposed to the wellbore 12, an interior of the casing 42, perforations (not shown), well screens (not shown), a perforated liner (not shown), etc.). Any surface in the well may be cleaned by the discharged fluid 30, in keeping with the scope of this disclosure.

The pulsations (e.g., flow and/or pressure fluctuations) in the flow of the fluid 30 enhance a cleaning effect of the discharged fluid. The pulsations can also enhance a penetration of the fluid 30 into the formation 14.

The vibratory reaction force 34 can be useful in the FIG. 2 example to produce a mechanical cleaning effect (e.g., localized vibration of the casing 42, etc.). Alternatively, or in addition, the reaction force 34 can bias the tubular string 18 to advance through the wellbore 12 in a direction opposite to the direction in which the fluid 30 is discharged from the fluid oscillator 26.

Figure 3:
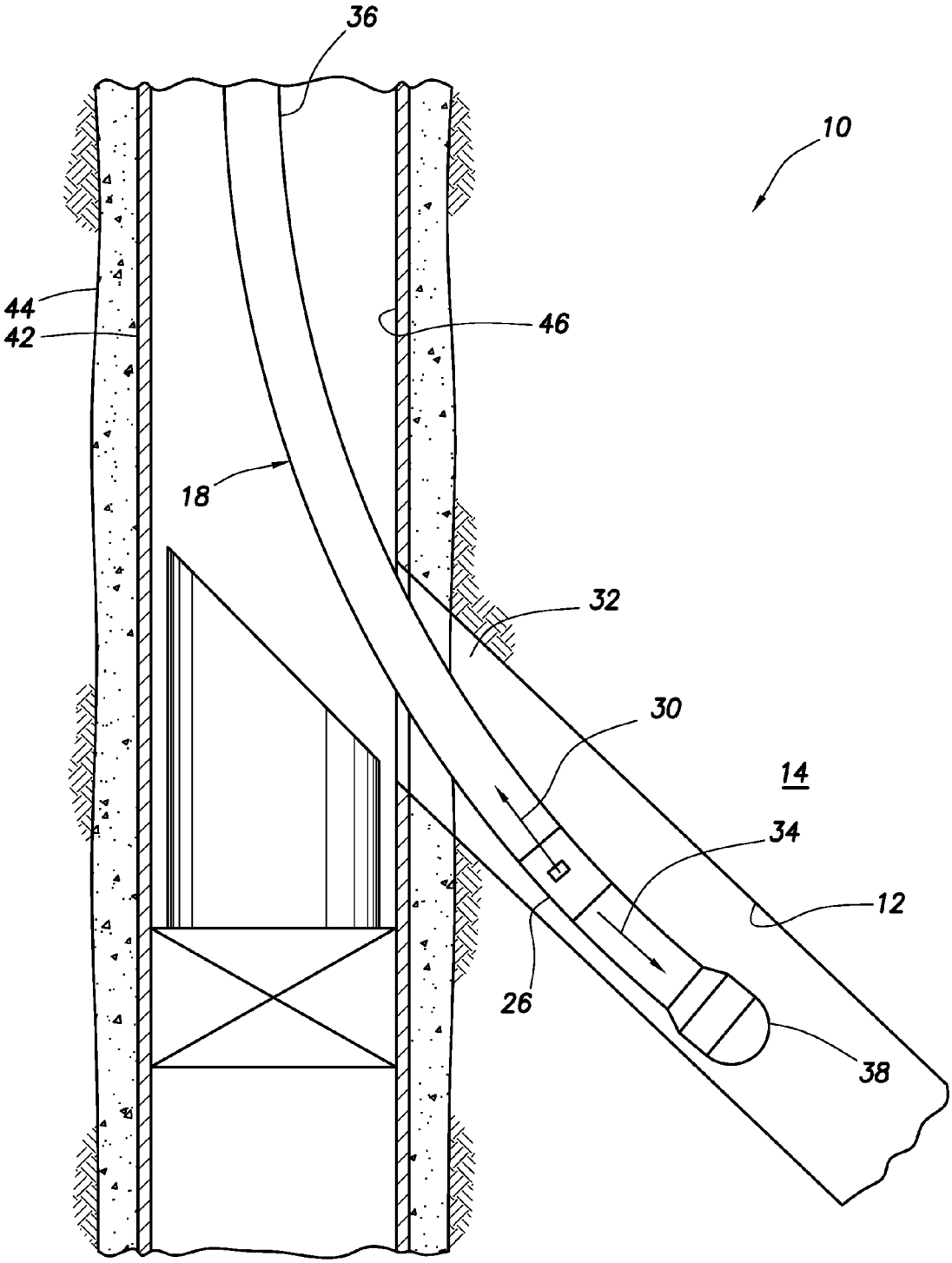
FIG. 3 is a representative partially cross-sectional view of yet another example of the system and method.

Referring additionally now to FIG. 3, another example of the system 10 and method is representatively illustrated. In this example, the wellbore 12 is a lateral or branch of another main or "parent" wellbore 46.

The lower end 38 of the tubular string 18 is to be deflected from the parent wellbore 46 into the branch wellbore 12. If the tubular string 18 is relatively flexible (for example, where the tubular string comprises coiled tubing 36 or another relatively flexible tubing), and/or the branch wellbore is a relatively long distance from the surface 22, and/or a substantial horizontal distance must be traversed, etc., it can be difficult to reliably deflect the lower end 38 of the tubular string into the wellbore 12.

However, with the fluid oscillator 26 interconnected in the tubular string 18 and discharging the fluid 30 upward (e.g., toward the surface end 20 of the tubular string), the reaction force 34 biases the lower end 38 downward (e.g., toward the lower end 38), thereby facilitating the deflection of the tubular string from the parent wellbore 46 into the branch wellbore 12. In addition, the reaction force 34 will continue to bias the tubular string 18 to advance through the wellbore 12, as long as the fluid 30 is discharged toward the surface end of the tubular string.

Figure 4:
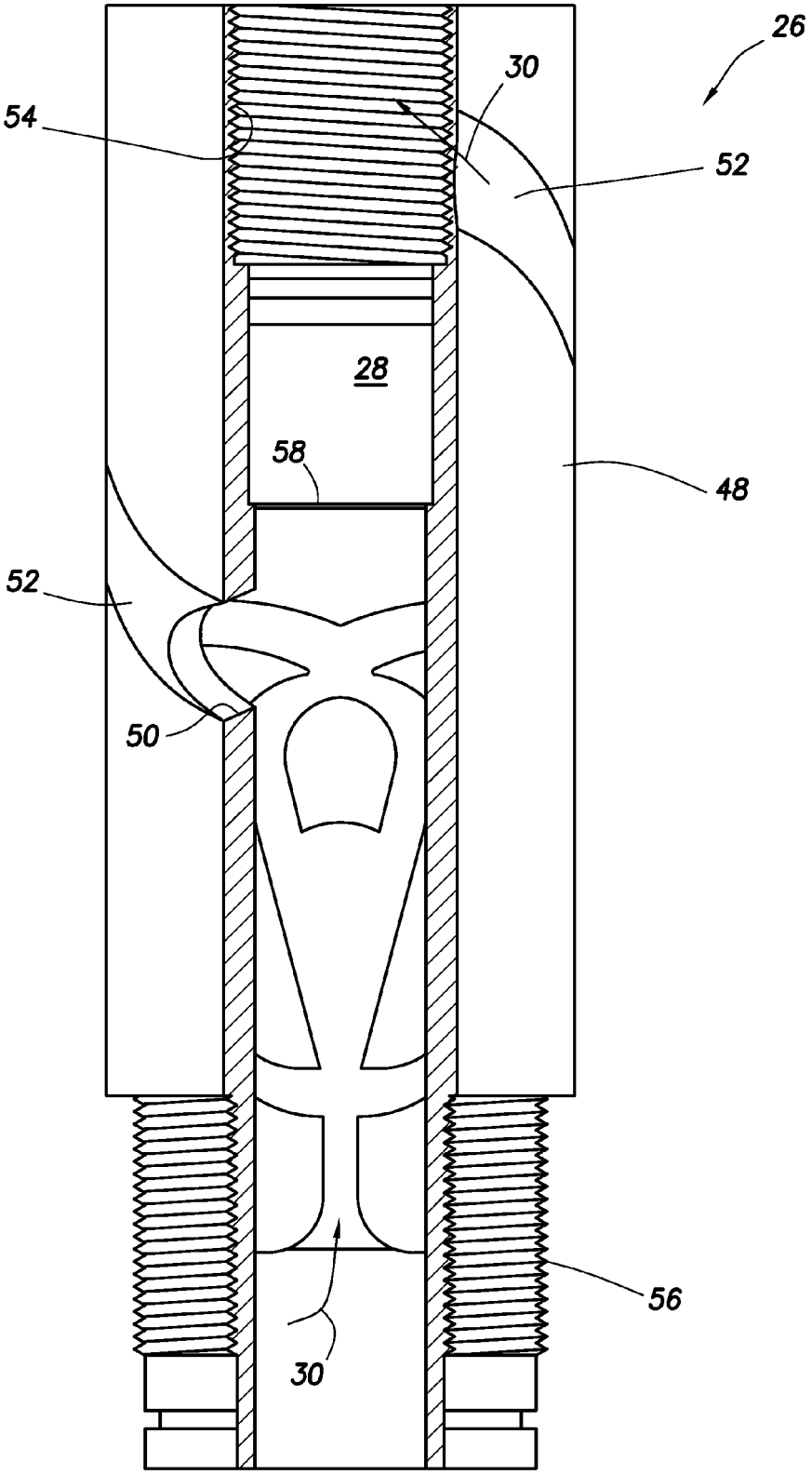
FIG. 4 is a representative partially cross-sectional view of a well tool which can embody the principles of this disclosure.
Figure 5:
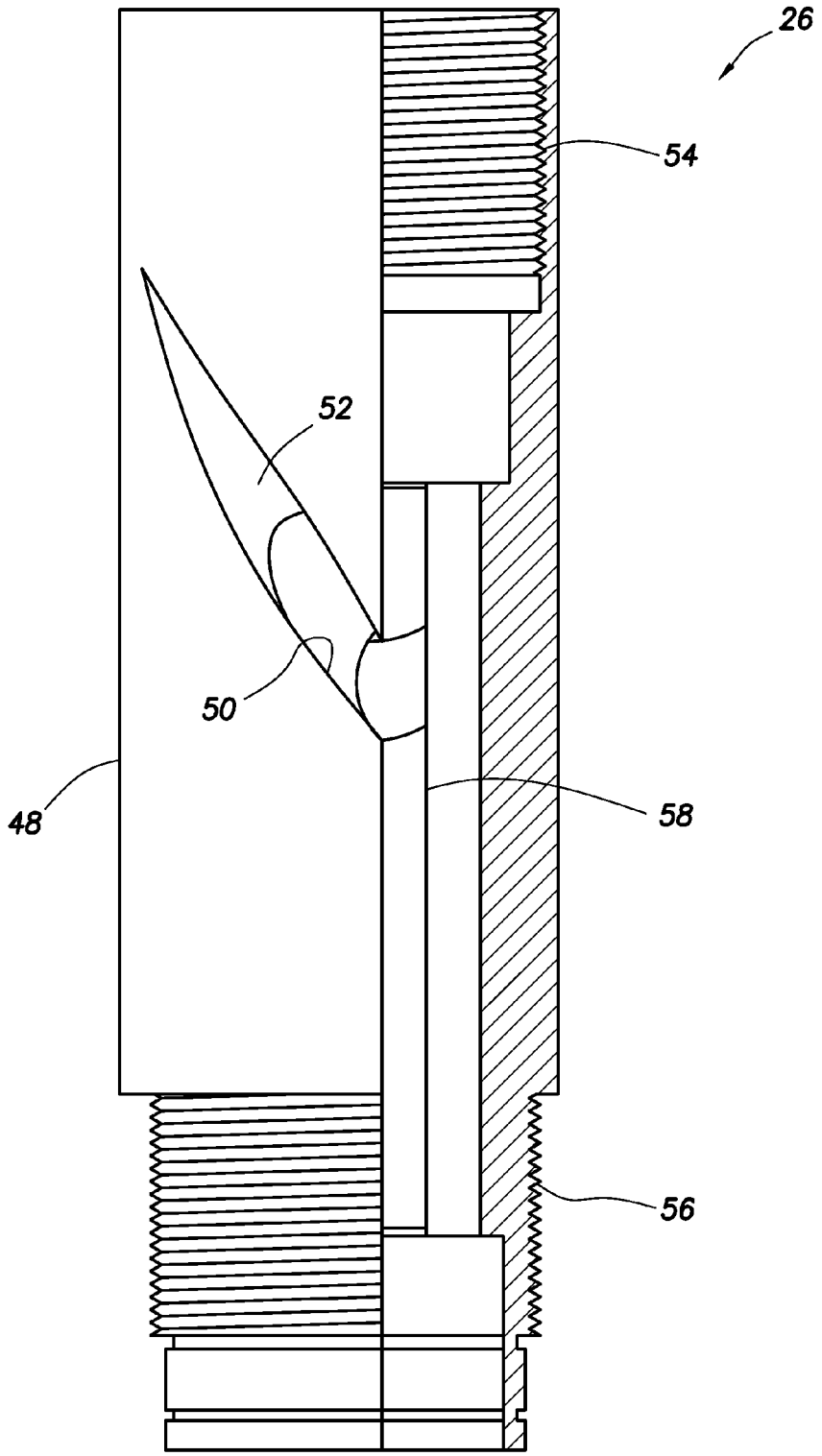
FIG. 5 is a representative partially cross-sectional side view of the well tool.

Referring additionally now to FIGS. 4 & 5, partially cross-sectional views of one example of the fluid oscillator 26 are representatively illustrated. The fluid oscillator 26 depicted in FIGS. 4 & 5 may be used in the system 10 and method examples described above, or they may be used in other systems and methods.

In the FIGS. 4 & 5 example, the fluid oscillator 26 includes a generally tubular housing 48 having ports 50 formed through a sidewall thereof. Only one of the ports 50 is visible, but in a preferred embodiment, two ports are provided, diametrically opposed to each other. Any number of ports 50 may be used in keeping with the scope of this disclosure.

The ports 50 are positioned at lower upstream ends of helical recesses or channels 52 formed in the housing 48. In this manner, fluid discharged from the ports 50 is directed to flow helically upward about the housing 48.

The housing 48 has end connections 54, 56 for connecting to other components of the tubular string 18. In the FIGS. 4 & 5 example, the end connections 54, 56 are sealed and threaded connections, but other types of connections may be used, if desired. For example, the housing 48 could be integrally formed with a housing of the drill bit 16 or fluid motor 24, etc.

When interconnected in the tubular string 18, the tubular string flow passage 28 extends at least partially through the fluid oscillator 26. In this manner, flow of the fluid 30 through the tubular string 18 causes the fluid to also flow through an insert 58 contained in the housing 48, whereby the insert produces pulsations in the flow of the fluid prior to it being discharged via the ports 50 and channels 52.

The insert 58 may be similar to any of the inserts described in the U.S. patent application Ser. No. 13/215,572 mentioned above, except that, in the FIGS. 4 & 5 example, the fluid 30 is discharged from the fluid oscillator 26 in a direction toward the surface end 20 of the tubular string 18. However, any means of producing pulsations in the flow of the fluid 30 may be used, in keeping with the scope of this disclosure.

In the FIGS. 4 & 5 example, the fluid 30 enters the insert 58 at a lower end thereof, and is alternately discharged from opposite lateral sides of the insert. Fluidics, as opposed to moving elements, is preferably used to cause the alternating flow of the fluid 30.

In other examples, the flow of the fluid 30 could be pulsed or fluctuated without it also alternating between the discharge ports 50, and/or one or more moving elements could be used. Therefore, it will be appreciated that the scope of this disclosure is not limited to any particular way of causing pulsations or fluctuations in the flow of the fluid 30.

Figure 6:
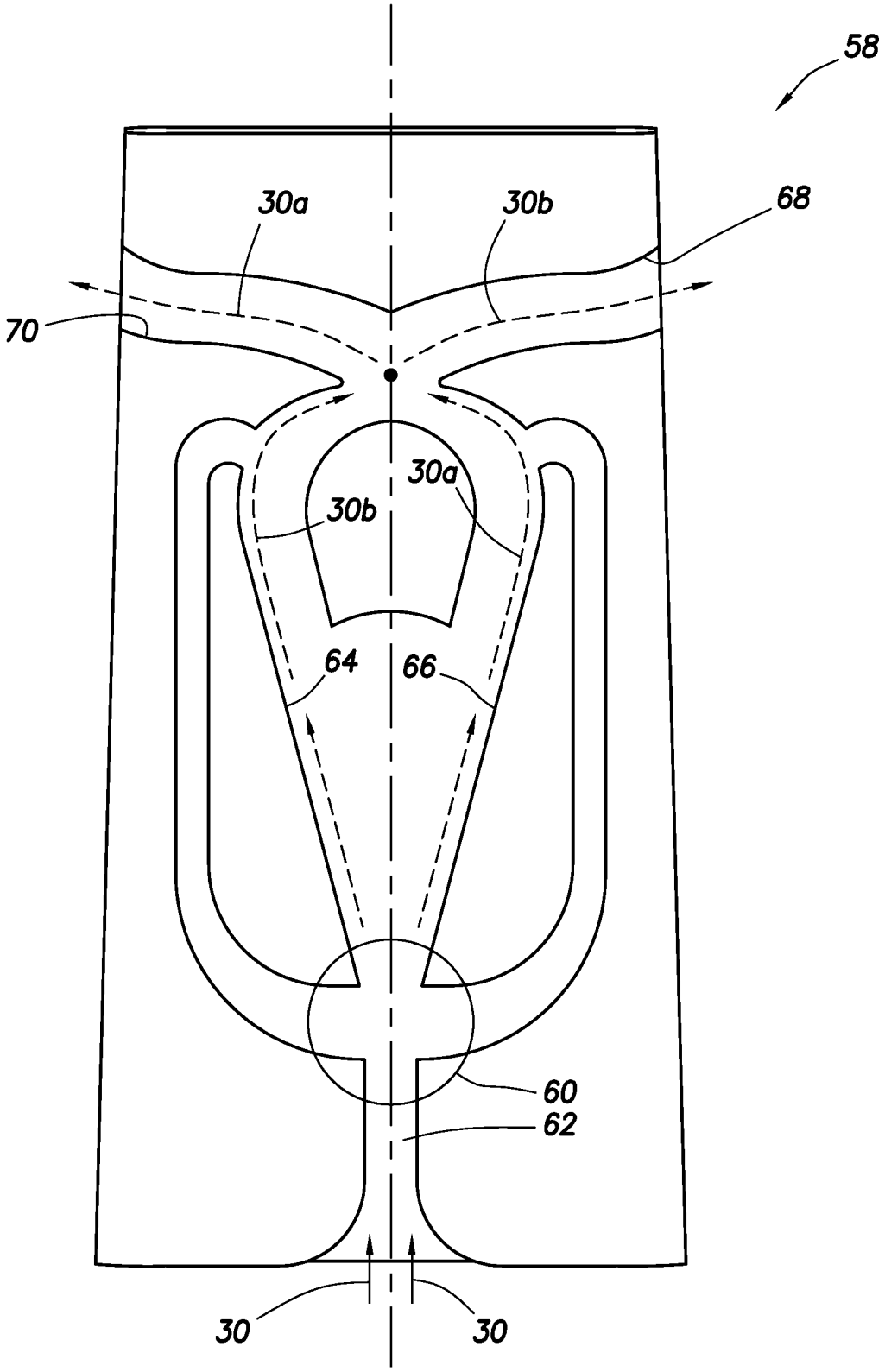
FIG. 6 is a representative view of an insert for use in the well tool, the insert having a fluid oscillator formed thereon.

Representatively illustrated in FIG. 6 is one example of the insert 58. The FIG. 6 example is similar to an insert described in the U.S. patent application Ser. No. 13/215,572 mentioned above. However, in the FIG. 6 example, alternating flows 30*a,b* of the fluid 30 are discharged at least partially upward from opposite lateral sides of the insert 58.

The flows 30*a,b* alternate by action of a fluid switch 60 which receives the fluid 30 from an inlet 62 at a lower end of the insert. The fluid switch 60 directs the fluid 30 to flow alternately along surfaces 64, 66, enhanced by the well-known Coanda effect.

Outlets 68, 70 of the insert 58 are aligned with the ports 50 in the housing 48. Thus, the fluid 30 is alternately discharged from the ports 50, in the FIG. 6 example.

Figure 7:
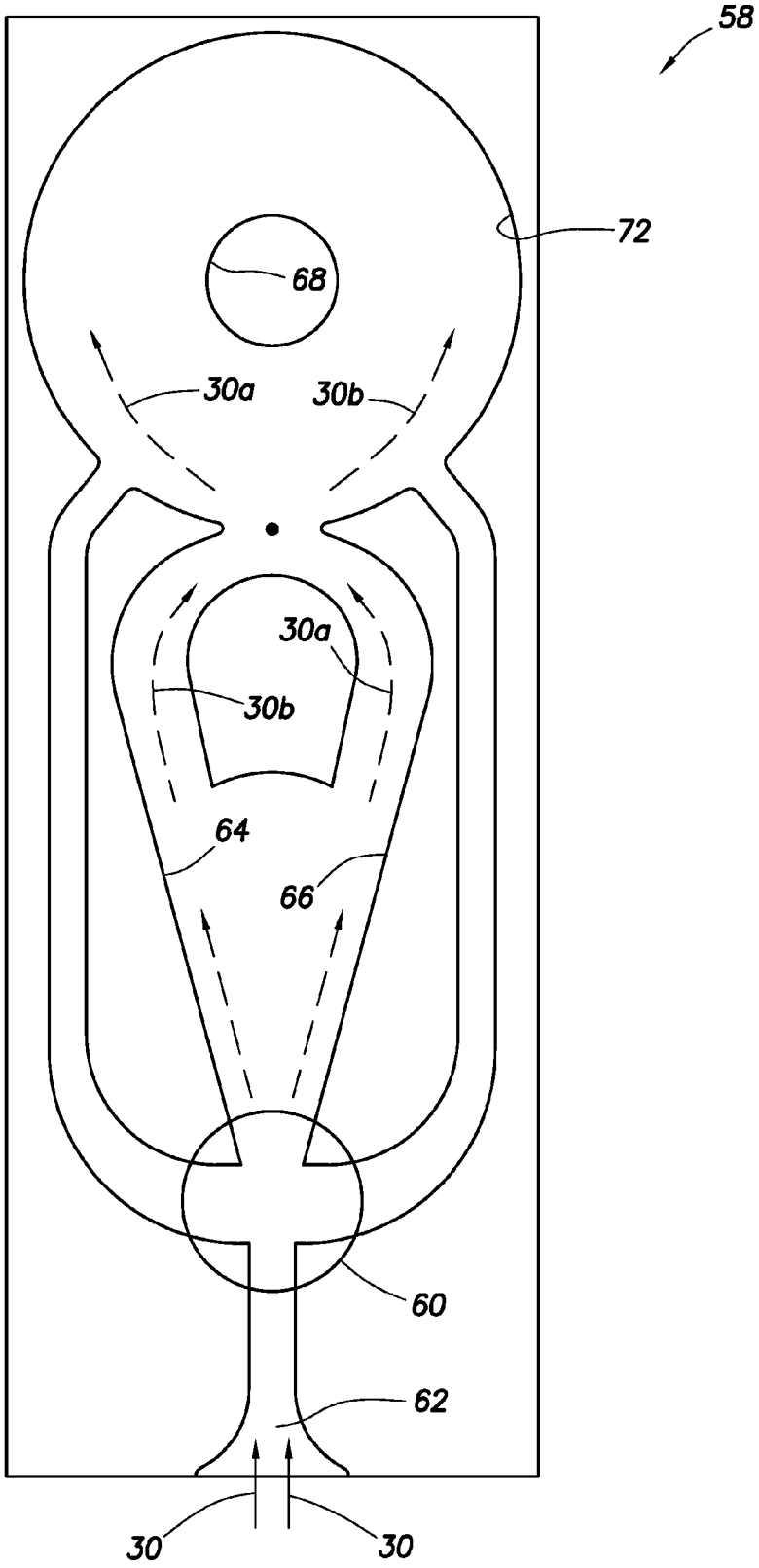
FIG. 7 is a representative view of another example of the insert.

Referring additionally now to FIG. 7, another example of the insert 58 is representatively illustrated. The FIG. 7 example shares some features with the FIG. 6 example, but in the FIG. 7 example the fluid 30 is not alternately discharged from multiple outlets 68, 70.

Instead, after alternately flowing along the surfaces 64, 66, the flows 30*a,b* enter a vortex chamber 72 prior to being discharged from an outlet 68. The flows 30*a,b* in the chamber 72 alternately "spin up" in opposite directions, and so a varying frequency of the pulsations or oscillations in the flow of the fluid 30 exiting the outlet 68 is produced.

Figure 8:
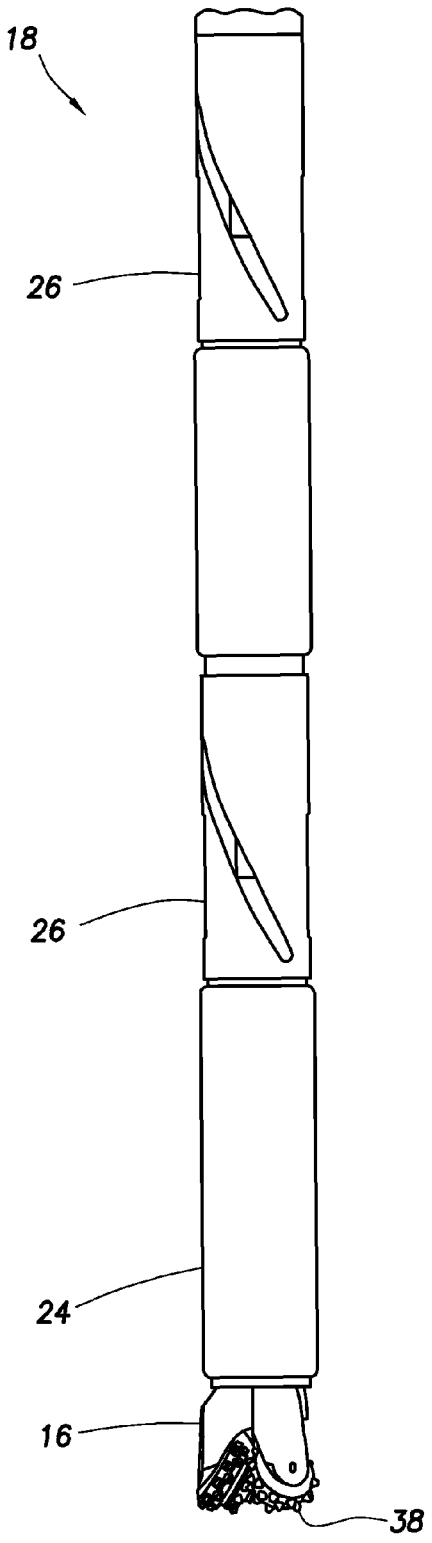
FIG. 8 is a representative side view of a tubular string which may be used in the system and method, and which can embody the principles of this disclosure.

Referring additionally now to FIG. 8, another example of the tubular string 18 is representatively illustrated. This example may be used in the system 10 and method examples described above, or it may be used with other systems and methods.

In the FIG. 8 example, multiple fluid oscillators 26 are interconnected in the tubular string 18. Any number of fluid oscillators 26 may be used, as desired.

The fluid oscillators 26 could be connected in series and/or in parallel. For example, pulsating flow output from an upper fluid oscillator 26 could be input to a next lower fluid oscillator, so that the output from the lower fluid oscillator is enhanced (e.g., with a complex compound pulsation, etc.).

As another example, each fluid oscillator 26 could be similarly connected between the flow passage 28 and the annulus 32, so that their outputs are substantially the same. Any manner of connecting the fluid oscillators 26 to each other, to the flow passage 28 and to the annulus 32 may be used, in keeping with the scope of this disclosure.

Preferably, the fluid oscillators 26 are configured and connected so that a capability of the fluid 30 to fluidize and carry the particulate matter 40 (e.g., drill cuttings, etc.) through the annulus 32 is enhanced. In addition, the vibratory reaction force 34 produced by the discharge of the fluid 30 from the fluid oscillators 26 is preferably generated so that the cleaning process is enhanced, cutting efficiency of the drill bit 16 is enhanced, and/or displacement of the tubular string 18 through the wellbore 12 is enhanced.

Figure 9:
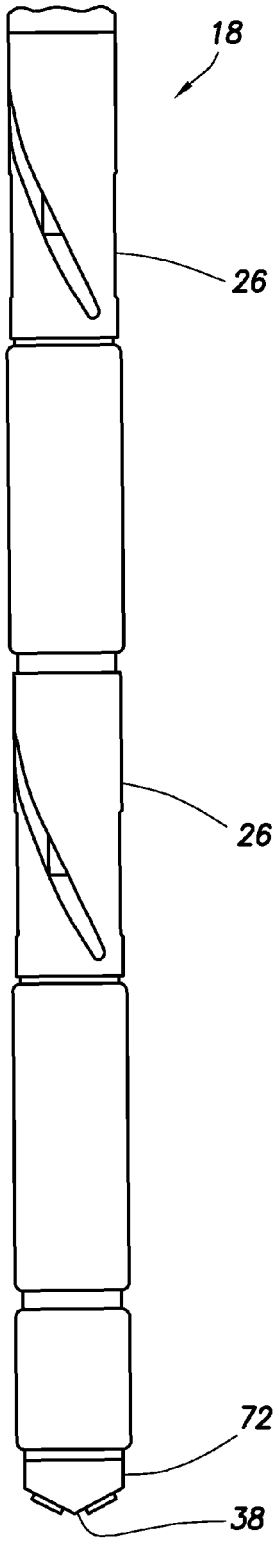
FIG. 9 is a representative side view of another example of the tubular string.

Referring additionally now to FIG. 9, another example of the tubular string 18 is representatively illustrated. In this example, the tubular string 18 includes a cleaning tool 72 connected at the lower end 38, instead of the drill bit 16. Similar to the FIG. 8 example, the FIG. 9 example includes multiple fluid oscillators 26 interconnected in the tubular string 18.

The cleaning tool 72 could be a jet-type cleaning tool used, for example, for cleaning well screens, gravel packs, perforations, etc. Any type of cleaning tool, or any other type of well tool, may be used in keeping with the scope of this disclosure.

Preferably, the fluid oscillators 26 are configured and connected so that a capability of the fluid 30 to fluidize and carry the particulate matter 40 (e.g., debris, sand, etc. dislodged by the cleaning tool 72) through the annulus 32 is enhanced. In addition, the vibratory reaction force 34 produced by the discharge of the fluid 30 from the fluid oscillators 26 is preferably generated so that the cleaning process is enhanced, and displacement of the tubular string 18 through the wellbore 12 is enhanced. Furthermore, suitably connected, the fluid oscillators 26 can deliver an output of pulsating flow to the cleaning tool 72, thereby enhancing the cleaning operation.

It may now be fully appreciated that the above disclosure provides significant advancements to the art. In some examples described above, the fluid 30 is discharged upwardly from the tubular string 18, thereby producing the downwardly directed reaction force 34, which can enhance drilling, displacement of the tubular string through the wellbore 12, etc. In some examples, the flow of the fluid 30 is also rotational about the tubular string 18, so that a capability of the fluid 30 to carry the particulate matter 40 through the annulus 32 is enhanced. In some examples, the flow of the fluid 30 is made to pulsate by the fluid oscillator 26, thereby varying the reaction force 34, enhancing a cleaning effect and producing other benefits.

A system 10 for use with a subterranean well is described above. In one example, the system 10 comprises a fluid oscillator 26 which discharges pulsating fluid 30 from a tubular string 18 in a first direction at least partially toward a first end 20 of the tubular string 18 proximate a surface 22 of the earth.

The fluid oscillator 26 may also discharge the pulsating fluid 30 rotationally about the tubular string 18.

The tubular string 18 may be positioned in a wellbore 12 inclined relative to vertical.

The discharged fluid 30 may carry particulate matter 40 through an annulus 32 formed between the tubular string 18 and a wellbore 12.

Discharge of the pulsating fluid 30 from the tubular string 18 can produce a vibratory reaction force 34 applied to the tubular string 18 in a second direction opposite to the first direction. The second direction is preferably toward a second end of the tubular string 18, the second end being inserted into the well. The second direction may be toward a drill bit 16 connected at a second end 38 of the tubular string 18.

The tubular string 18 may comprise a coiled tubing 36. However, use of coiled tubing 36 is not necessary, in keeping with the scope of this disclosure.

Discharge of the fluid 30 from the tubular string 18 may apply a reaction force 34 to the tubular string 18, which reaction force 34 at least partially biases the tubular string 18 into the well.

The discharged fluid 18 may be used to clean a well surface. The well surface could be a surface of the formation 14 exposed to the wellbore 12, an interior of the casing 42, perforations (not shown), well screens (not shown), a perforated liner (not shown), or another surface of the well.

Also described above is a method for use with a subterranean well. In one example, the method comprises discharging a fluid 30 from a tubular string 18 in the well, thereby applying a reaction force 34 to the tubular string 18, which reaction force 34 biases the tubular string 18 at least partially into the well.

The discharging step can include discharging the fluid 30 in a direction at least partially toward an end 20 of the tubular string 18 proximate a surface 22 of the earth.

The discharging step may include discharging the fluid 30 from a fluid oscillator 26, flowing the fluid 30 rotationally about the tubular string 18, and/or producing pulsations in a flow of the fluid 30.

The discharging step can include the discharged fluid 30 carrying particulate matter 40 through an annulus 32 formed between the tubular string 18 and a wellbore 12.

The discharging step may include pulsing the fluid 30, whereby the reaction force 34 is vibratory.

The reaction force 34 may be applied to the tubular string 18 at least partially toward an end 38 of the tubular string 18 in the well, and/or toward a drill bit 16 connected at an end 38 of the tubular string 18.

Another method is described above. In this example, the method can include discharging a pulsating fluid 30 from a fluid oscillator 26 in a first direction at least partially toward a first end 20 of the tubular string 18; and drilling into an earth formation 14 with a drill bit 16 connected at a second end 38 of the tubular string 18 in the well.

Yet another method can comprise discharging a fluid 30 from a tubular string 18 in the well, thereby applying a vibratory reaction force 34 to the tubular string 18. The reaction force 34 is directed at least partially toward an end 38 of the tubular string 18 in the well.

The reaction force 34 can be helically directed. The vibratory reaction force 34 can be used to clean a well surface.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. For example, the term "upward" is sometimes used above to refer to a direction along the tubular string 18 toward the surface end 20 of the tubular string, and the term "downward" is sometimes used above to refer to a direction along the tubular string 18 toward the downhole end 38 of the tubular string. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a tubular string including first and second ports; and a fluid oscillator, wherein fluid is discharged from the tubular string alternately via the first and second ports in a first direction at least partially toward a first end of the tubular string proximate a surface of the earth, and wherein discharge of the fluid from the tubular string produces a vibratory reaction force applied to the tubular string in a second direction opposite to the first direction.

2. The system of claim 1, wherein the second direction is toward a second end of the tubular string, the second end being inserted into the well.

3. The system of claim 1, wherein the second direction is toward a drill bit connected at a second end of the tubular string.

4. A system for use with a subterranean well, the system comprising:

a tubular string including first and second ports; and a fluid oscillator, wherein fluid is discharged from the tubular string alternately via the first and second ports in a direction at least partially toward an end of the tubular string proximate a surface of the earth, and wherein discharge of the fluid from the tubular string applies a reaction force to the tubular string, which reaction force at least partially biases the tubular string into the well.

5. A method for use with a subterranean well, the method comprising:

alternately discharging a fluid from a tubular string via first and second ports, wherein each fluid discharge applies a reaction force to the tubular string, which reaction force biases the tubular string at least partially into the well.

6. The method of claim 5, wherein the discharging further comprises discharging the fluid in a direction at least partially toward an end of the tubular string proximate a surface of the earth.

7. The method of claim 5, wherein the discharging further comprises discharging the fluid from a fluid oscillator.

8. The method of claim 5, wherein the discharging further comprises flowing the fluid rotationally about the tubular string.

9. The method of claim 5, wherein the discharging further comprises producing pulsations in a flow of the fluid.

10. The method of claim 5, wherein the tubular string is positioned in a wellbore inclined relative to vertical during the discharging.

11. The method of claim 5, wherein the discharging further comprises the discharged fluid carrying particulate matter through an annulus formed between the tubular string and a wellbore.

12. The method of claim 5, wherein the discharging further comprises pulsing the fluid, whereby the reaction force is vibratory.

13. The method of claim 5, wherein the reaction force is applied to the tubular string at least partially toward an end of the tubular string in the well.

14. The method of claim 5, wherein the reaction force is applied at least partially toward a drill bit connected at an end of the tubular string.

15. The method of claim 5, wherein the tubular string comprises a coiled tubing.

16. The method of claim 5, wherein the discharged fluid cleans a well surface.

17. A method for use with a subterranean well, the method comprising:

discharging a pulsating fluid from a fluid oscillator, wherein the fluid is alternately discharged from a tubular string via first and second ports in a first direction at least partially toward a first end of the tubular string; and drilling into an earth formation with a drill bit connected at a second end of the tubular string, wherein the discharging further comprises producing a vibratory reaction force applied to the tubular string in a second direction opposite to the first direction.

18. The method of claim 17, wherein the second direction is at least partially toward the second end of the tubular string.

19. A method for use with a subterranean well, the method comprising:

discharging a pulsating fluid from a fluid oscillator, wherein the fluid is alternately discharged from a tubular string via first and second ports in a direction at least partially toward a first end of the tubular string; and drilling into an earth formation with a drill bit connected at a second end of the tubular string, wherein the discharging applies a reaction force to the tubular string, which reaction force at least partially biases the tubular string into the well.

20. A method for use with a subterranean well, the method comprising:

alternately discharging a fluid from a tubular string via first and second ports, wherein each fluid discharge applies a vibratory reaction force to the tubular string, which reaction force is directed at least partially toward an end of the tubular string in the well.

21. The method of claim 20, wherein the discharging further comprises discharging the fluid in a direction at least partially toward an end of the tubular string proximate a surface of the earth.

22. The method of claim 20, wherein the discharging further comprises discharging the fluid from a fluid oscillator.

23. The method of claim 20, wherein the discharging further comprises flowing the fluid rotationally about the tubular string.

24. The method of claim 20, wherein the discharging further comprises producing pulsations in a flow of the fluid.

25. The method of claim 20, wherein the tubular string is positioned in a wellbore inclined relative to vertical during the discharging.

26. The method of claim 20, wherein the discharging further comprises the discharged fluid carrying particulate matter through an annulus formed between the tubular string and a wellbore.

27. The method of claim 20, wherein the reaction force is helically directed.

28. The method of claim 20, wherein the reaction force is applied at least partially toward a drill bit connected at an end of the tubular string.

29. The method of claim 20, wherein the tubular string comprises a coiled tubing.

30. The method of claim 20, wherein the vibratory reaction force cleans a well surface.

* * * * *